US005302184A

United States Patent [19]

Batterham et al.

[11] Patent Number: 5,302,184

[45] Date of Patent: Apr. 12, 1994

[54] MANUFACTURE OF FERROALLOYS USING A MOLTEN BATH REACTOR

[75] Inventors: Robin J. Batterham, Sandringham; Roderick M. Grant, Doncaster; James V. Happ, Ringwood, all of Australia; Glenn A. Thiele, Williams Lake, Canada

[73] Assignee: CRA Services Limited, Melbourne, Australia

[21] Appl. No.: 768,432

[22] PCT Filed: May 30, 1990

[86] PCT No.: PCT/AU90/00233

§ 371 Date: Sep. 26, 1991

§ 102(e) Date: Sep. 26, 1991

[87] PCT Pub. No.: WO90/15165

PCT Pub. Date: Dec. 13, 1990

[30] Foreign Application Priority Data

Jun. 2, 1989 [AU] Australia ..... PJ 4546

[51] Int. Cl.[5] ..... C22C 35/00; C22C 38/18

[52] U.S. Cl. ..... 75/501; 75/502; 75/623

[58] Field of Search ..... 75/623, 501, 502

[56] References Cited

U.S. PATENT DOCUMENTS

| | | | |
|---|---|---|---|
| 2,745,737 | 5/1956 | Oster . | |
| 3,158,464 | 11/1964 | Chynoweth | 75/623 |
| 3,865,573 | 2/1975 | Neumann et al. . | |
| 4,259,296 | 3/1981 | Hennion et al. . | |
| 4,565,574 | 1/1986 | Katayama et al. . | |
| 4,944,799 | 7/1990 | Tanabe et al. | 75/501 |
| 4,961,784 | 10/1990 | Tanabe et al. | 75/623 |
| 5,050,849 | 9/1991 | Hardie et al. . | |

FOREIGN PATENT DOCUMENTS

| | | |
|---|---|---|
| PI6745 | 2/1988 | Australia . |
| 0222397 | 5/1987 | European Pat. Off. . |
| 0330482 | 8/1989 | European Pat. Off. . |
| 2524905 | 10/1983 | France . |
| 62-188713 | 8/1987 | Japan . |
| 2082624 | 3/1982 | United Kingdom . |

OTHER PUBLICATIONS

Moodie et al, "Numerical Modelling for the Analysis of Direct Smelting Processes", 1988, Process Technology Conference Proceedings, pp. 55–64.

Patent abstract of Japanese Published Patent Application, Pub. No. 58 104153, Pub. Date: Jun. 21, 1983.

*Primary Examiner*—Melvyn J. Andrews

*Attorney, Agent, or Firm*—Larson and Taylor

[57] ABSTRACT

The specification discloses a process for producing a ferroalloy in a smelting vessel. A material containing an alloying metal is injected into a molten bath contained in the vessel. A flux, a carbonaceous material and an oxygen-containing gas are also injected into the vessel. A gas which may be the oxygen-containing gas is injected into the molten bath in order to stir it. The rates of injection of the various components are controlled to achieve control of the oxidizing and reducing environment within the vessel consistent with a rapid rate of injection. The material containing the alloying metal is either reduced and incorporated into the metal phase or oxidized and incorporated into the slag. Combustion gases above the molten bath are oxidized to provide further heat to the process. Alloyed metal or slag containing the alloying metal are recovered as product. The process is applicable to the production of ferroalloys such as ferrochromium, ferromanganese, ferronickel and ferrovanadium.

21 Claims, No Drawings

MANUFACTURE OF FERROALLOYS USING A MOLTEN BATH REACTOR

FIELD OF THE INVENTION

This invention relates to the manufacture of certain ferroalloys by the addition of alloying metal-containing ores plus fluxing agents and solid carbonaceous reductants to a molten bath reactor. This invention also provides for the upgrading of the alloying metal to iron ratio of ferroalloys by oxidation and reduction refining operations.

In this specification, the term 'ferroalloy' refers to ferrochromium, ferromanganese, ferronickel and ferrovanadium. The term 'alloying metal' has a corresponding meaning, that is, chromium, manganese, nickel and vanadium, as have the terms 'alloying metal-containing ores' and 'alloying metal-containing material'. The latter, wider term includes alloying metal-containing ores or concentrates, or preheated alloying metal-containing ores or concentrates or preheated and prereduced alloying metal-containing ores or concentrates. The preferred alloying metal is chromium and the particular description refers to chromium to exemplify the invention.

BACKGROUND OF THE INVENTION

The conventional industrial method of manufacturing ferrochrome or charge chrome is in the submerged arc electric furnace. Chrome ore, reducing agent and flux are fed continuously into the smelting furnace. Fine feed material makes furnace operation difficult and can lead to large chromium losses. Hence fine feed materials are either avoided or agglomerated before charging. Optionally agglomerates of ore and reducing agent can be preheated and/or prereduced before being fed to the electric furnace. Fine feed materials can be used if they are firstly agglomerated; for example by pelletizing or by high temperature fusing.

In the electric smelting furnace, energy is supplied through carbon electrodes immersed in the charge. Gases, resulting from the reaction of ore and carbon deep in the furnace, flow upward and are released at the top of the furnace charge.

Often the furnace tops are closed with a water-cooled cover which has openings for electrodes and charge delivery. The cover permits the collection of the gases generated. Much of this gas consists of carbon monoxide, which can then be used as a fuel. In some installations the furnace top is left uncovered and the gases are burned at the surface.

Accurate weighing and proportioning of the feed materials is essential for the successful operation of the furnace. The feed above the reaction zone should be porous so as to permit the flow of product gases. Furthermore, the feed should be proportioned and fed in such a manner to allow the feed to descend freely into the furnace without bridging. Feed mixes of too large a particle size or particle size range are generally not used since they can be difficult to procure and cause furnace charging and bridging problems. They may also cause greater electrical resistance. However, too small a particle size in the feed mix can lead to losses by gas entrainment, low bed porosity and mix bridging.

The liquid slag and alloy products are drained from the furnace through a taphole either continuously or intermittently. The slag may separate from the alloy by decantation, skimming or bottom tapping of the receiving ladle. The ferrochrome product is then cast in chills.

Whilst this method of ferrochrome production is most widespread, it does present several disadvantages. Firstly, most or all of the energy requirements of the smelting process are supplied by electricity, which is an expensive form of energy. Secondly, the reductant requirements are met by using coke. Coke is a costly reductant, and is becoming more difficult to obtain as world supplies of coking coals are depleted and increasingly stringent environmental restrictions are placed on the operation of coke oven batteries. Thirdly, the feed particle size limitations preclude the direct use of cheaper fine-sized ore feed.

An alternative technology for the production of ferroalloys (including ferrochrome) which is now emerging is plasma carbothermic smelting reduction. This method has a number of advantages over the submerged arc furnace process:

fine-sized materials are the preferred charge;

the reductant need not be coke-coal fines or coke breeze are suitable;

uniform and consistent charge material properties are not crucial;

slag composition can be selected independently of electrical resistivity, making it possible to operate at a slag composition which minimizes losses of alloy metal to the slag;

process control is much improved, since the process is not as sensitive to charge material properties; and the plasma furnace operates at lower noise levels.

However, in spite of these advantages the plasma smelting process still suffers from the serious disadvantage in that all of the smelting energy requirement is supplied in the form of expensive electricity.

In an effort to reduce the cost of manufacturing the ferrochrome alloy, a number of processes have been proposed which avoid supplying the energy for smelting in the form of electricity.

In U.S. Pat. No. 4,565,574 (Nippon Steel Corporation) a process for the production of high chromium alloys by smelting reduction is disclosed. In this process powdered coke and chromium containing ore are pelletized and dried. The pellets are then charged to a rotary kiln, where they are heated and partially reduced. Further coke and limestone flux may be added part-way along the rotary kiln to improve the reduction of the pellets, to preheat the coke and to calcine the limestone.

According to the Nippon Steel patent, the maximum temperature within the rotary kiln is kept above 1400° C. On discharge the prereduced pellets, coke and flux drop from the kiln down a chute into the top of a smelting reduction furnace. This furnace is similar in shape to an ordinary steelmaking converter. The furnace has typically four bottom-blowing tuyeres for oxygen supply, which are protected by propane, whilst the bulk of the oxygen is introduced above the bath through a lance. To maintain control of the temperatures of the slag and metal phases and of the levels of oxidation within these phases, it is necessary to blow oxygen both above and below the bath whilst simultaneously injecting coke into the slag from the top of the smelt reduction vessel.

Smelting of the ore proceeds batchwise, in two stages. Firstly, with a converter temperature of 1580° to 1630° C., preheated, prereduced pellets, coke and flux are charged to the vessel whilst top and bottom blowing with oxygen. A second stage then follows, when no ore or flux is charged, and oxygen additions are progressively reduced, to minimise the chromium content of the slag. However, still more coke must be added to the vessel during this second stage, to control the state of oxidation of the slag and metal phases. The slag and metal are then removed from the vessel.

It is necessary to burn at least 30% of the combustible gases, leaving the bath using an overhead oxygen lance in order to obtain good utilization of the carbonaceous materials and coke used. However, combustion levels above 50% are not desirable due to the quantities of $SO_x$ and $NO_x$ generated.

Furthermore although the specification of U.S. Pat. No. 4,565,574 refers to the need for "hard stirring", the upper limit to stirring intensity is determined by the rate at which the bath lining degrades. At a higher stirring intensity, the stirring of the slag contributes to lining degradation. Stirring intensity is optimized when the temperature of the bath is uniform.

Another process is known (Japanese Patent 58-117852 Sumitomo Metal Industries) where a chrome-containing ore is charged to a bath of molten iron in a top-and-bottom blown converter. Fine chromium ore, fluxes and lump coke are dropped onto the surface of the melt, whilst oxygen is blown softly through a top lance. Coke floating on the slag surface is partially burnt by this oxygen, residual coke being drawn into the slag by agitation induced by oxygen and nitrogen introduced through side blowing nozzles and by bottom blown nitrogen. Circulation produced by the injected gases transfers heat to the slag and metal and allows the coke to reduce the chrome oxide in the slag.

The solid feed is charged to the converter for the duration of the smelting period. A finishing reduction period then follows, during which no solids are charged, and oxygen is introduced only onto the surface of the bath. This finishing reduction lowers the chromium content of the slag and gives a stainless steel grade chromium alloy of 20–32% chromium.

Although this process avoids smelting with electrical energy and can use fine sized ores, it requires lump coke, and each batch requires a charge of molten iron. Furthermore, it is only suitable for making a low chromium alloy. The process does not yield a charge chrome quality ferroalloy.

Another process is also known (Japanese patent 59-107011 Kawasaki) wherein fine chromium-containing ore is optionally prereduced and then fed into a shaft furnace with air or oxygen-enriched air. Lump coke is used as a solid reducing material, and is charged into the shaft furnace from the top. The injected ore melts in front of the tuyeres through which it is injected, and is reduced to the metal as it drips through the coke bed. The furnace hot-reduction zone is increased by injecting coal and an oxygen-containing gas into the shaft furnace through a second row of tuyeres located below the ore-injection tuyeres.

Slag and ferroalloy are tapped from the base of the furnace. Slags have been reported with chromium contents of less than 0.6% and metals containing 8 to 50% chromium have been obtained. Whilst this process also avoids the use of electrical energy for smelting, it is still dependent on the use of lump coke.

Generally speaking, there are major problems in the prior art processes. These include:

the difficulties of using finely sized ores directly;

the requirement for expensive coke;

the use of expensive electrical energy for smelting;

the simultaneous control of the states of oxidation of the slag and metal phases; and the limited use of the chemical energy (reducing potential) and sensible heat of product gases within the smelting vessel.

Whilst certain of the prior art processes have found particular solutions to some of the above problems, none of the prior art processes discussed above simultaneously solves all of the above problems to the extent achieved by the current invention.

It is known in the prior art to form a molten bath, which contains chiefly iron, iron oxides and slag forming materials, wherein iron oxides can be reduced directly to iron. In one known process, the source of energy is provided by injecting carbonaceous material, carrier gas and protective gas into the bath. At least a part of the fuel undergoes combustion. The reaction gases which are generated agitate the bath causing molten material to be projected from the bath into a transition zone above the level of the bath. Oxygen-containing gas is injected in the form of a jet or jets into the space above the bath. The injected gas combusts with the reaction gases released from the bath. The gases produced impinge on molten material in the transition zone, whereby energy generated by the post-combustion is transferred to the molten material in the transition zone.

It is an object of the present invention to provide a process for the bath smelting of alloying metal-containing material, such as chromium-containing material, to, for example, either a crude stainless steel or a charge chrome quality ferroalloy, which avoids the use of electrical energy for smelting and does not require lump or agglomerated alloying metal-containing materials.

It is a further object of this invention to reduce or eliminate requirements for coke.

It is a further object of this invention to make greater use of the chemical energy and sensible heat of product gases within the smelting vessel.

A further object of this invention is to provide good control of the states of oxidation of the slag and metal phases.

BRIEF SUMMARY OF THE INVENTION

Surprisingly it has been discovered that a molten bath of the type containing chiefly iron, which is described above, can be adapted for use in the manufacture of ferroalloys, for example, ferrochrome, by the method according to the invention described below.

It has been discovered that finely-sized alloying metal-containing material can be processed in such a molten bath without the need for any form of feed agglomeration.

It has also been discovered that a sufficiently reducing environment for the smelting reduction of an alloying metal-containing material can be achieved with the reduction or elimination of a requirement for coke.

A further inventive aspect of the method according to the invention is that the smelting of the alloying metal-containing material is possible in a bath smelting process, thus avoiding the need for electricity.

An inventive aspect of one embodiment of the method according to the invention is the ease of control of the oxygen potential of the molten bath to direct the reporting of chromium to the slag or the metal phase. Fluxes may also be used in this connection.

The method according to the invention also provides a significant saving in energy as a result of the greater use of the chemical energy and sensible heat of product gases within the smelting vessel.

Accordingly, this invention provides a process for producing a ferroalloy comprising the following steps:

(a) injecting an alloying metal-containing material and a flux at controlled rates into a bath comprising molten material containing iron or derived from an iron containing material;

(b) injecting an oxygen-containing gas and a carbonaceous material at controlled rates into the bath or into a space above the bath or both;

(c) injecting a gas into the bath to assist reaction gases formed in the bath in creating a transition zone immediately above the bath, the transition zone containing molten material projected from the bath by the gas and the reaction gases;

(d) controlling the rate of injection of the alloying metal-containing material, the flux, the oxygen-containing gas and the carbonaceous material to achieve rapid incorporation of the alloying metal-containing material and the flux into the bath as well as control the oxidation/reduction environment within the bath;

(e) causing the alloying metal to be reduced and report to a metal phase or oxidized and report to a slag phase; and (f) recovering the phase containing the alloying metal.

The alloying metal-containing slag may be further treated, as described later, to produce an alloying metal alloy.

The process according to the invention is capable of incorporating finely sized alloying metal-containing material into the molten bath.

In the specification the term "molten bath" refers to a molten bath having a metal phase comprising chiefly iron and, usually, a slag phase.

In the specification the term 'carbonaceous material' refers to any carbon-based material which can be burned to produce a suitably high temperature and includes: anthracite, bituminous or sub-bituminous coal, coking or steaming coal, lignite or brown coal, heavy petroleum residues and natural gas. The lignite or brown coal may have been densified using the process disclosed in Australian patent no. 561686 and applications no. 5259086 and 52422/86.

It should be noted that, while the process according to the invention does not require coke or char, the process does work quite satisfactorily if coke or char is used as the carbonaceous material. Lignite and brown coal derived chars may be included in this category. A process for preparing a char from a densified lignite or brown coal product is disclosed in Australian patent application no. 52234/86.

It should be noted that the process according to the invention includes the case where some proportion of alloying metal-containing scrap and/or plant dust is added to the bath. Agglomerated alloying metal-containing material or composites of alloying metal-containing material and reducing agent may also be added.

In the specification the term 'oxygen-containing gas' refers to pure oxygen and gas containing oxygen, including air and oxygen-enriched air.

It is notable that a high degree of energy efficiency of the coal used is obtained by burning the combustible gas, which leaves the molten bath, above the bath in a manner that returns much of the heat of post-combustion to the molten bath without re-oxidizing the metal or slag phases contained in the bath.

DETAILED DESCRIPTION

Alloying metal-containing material may be introduced to the molten bath by injection through the roof of the smelting vessel, or by injection through tuyeres below the bath surface, or through both the roof and below the bath surface. Injection through the roof can be through the same tuyere or tuyeres used to admit the oxygen-containing gas. Similarly any necessary fluxing agents and any carbonaceous material can be injected in a similar manner. It has been found to be particularly beneficial to inject through the top tuyere or tuyeres when the charge is hot.

The oxygen-containing gas may be injected into the space above the molten bath. However, if the oxygen-containing gas is also injected into the molten bath, to promote rapid reduction by reaction with carbonaceous material, it must be injected through tuyeres adapted to resist the severe environment, for example, by cooling and shielding with natural gas. If air is used as the oxygen-containing gas, it is preferable that it be preheated, for example to 1200° C., to avoid excessive coal consumption.

The temperature of the molten bath must be maintained from 1300° to 1900° C., preferably from 1400° to 1800° C., more preferably 1500° to 1700° C., to obtain a satisfactory rate of reduction. Thus it is an important aspect of this invention, that to run with liquid slags, the temperature of the molten bath is likely to be significantly greater than that encountered in the known iron-making process by means of a molten bath.

A surprising aspect of this invention is that it can be operated at lower temperatures, such as those of iron-making, at which conditions the slag may be solid, providing bottom gas injection rates are kept sufficiently high to maintain a transition zone above at least part of the bath surface. In such circumstances the slag may be removed by mechanical means, or the temperature of the slag may be raised at the time of tapping so that it discharges in a molten state.

According to this invention the addition of carbonaceous material to the molten bath is controlled so as to maintain a carbon content in the molten metal alloy in the range from 3 to 12% by weight, and the more preferable from 4 to 9% by weight. An important aspect of this invention is the requirement that the dissolved carbon content of the molten bath be higher than is the practice in the known iron-making process by means of a molten bath. It has been found that reduction of, for example, chromium-containing materials has more significant kinetic limitations than in the case of reducing iron oxide materials. This invention provides for appropriately reducing conditions to rapidly smelt alloying metal-containing materials to a ferroalloy by operating the molten bath at the high carbon contents mentioned above.

The carbon monoxide and hydrogen in the gases above the molten bath should preferably be post-combusted to a minimum extent of from 40 to 60%. The extent of post-combustion is defined as the combined volume percentage of carbon monoxide and hydrogen leaving the molten bath which is then combusted in the space above the bath by reaction with the oxygen-containing gases injected into the space.

Fluxing agents may be added to ensure the slag has a suitable melting point and is of adequate fluidity at the temperatures employed. Fluxing agents may also be added to reduce or minimise the extent to which the slag foams within the vessel. Furthermore, fluxing agents may be added to control the reporting of alloying metal to the slag and/or the alloy.

This process may be conducted either as a continuous operation, or on a batch basis. In a continuous operation, the molten slag and metal may be withdrawn either continuously or intermittently.

In one embodiment of this invention, when the grade and/or alloying metal to iron ratio of the alloying metal-containing feed material are sufficiently high, a high alloying metal content ferroalloy will result, and, for example, a charge chrome product will be produced with little or no further processing needed.

In another embodiment of this invention, the charge material used is a high grade alloying metal-containing material, and the process is operated on a batch basis. In this embodiment, the alloying metal-containing material is charged to the smelting reduction vessel for less than 100% of the smelting period of the batch cycle. For the remainder of the smelting period of the batch cycle, reducing conditions are maintained within the bath without feed material being added, so as to reduce the alloying metal content of the slag to a low level. After this slag reduction period there is little alloying metal value in the slag, and it may be discarded. Furthermore, recovery of alloying metal to the metal phase is enhanced, and, for example, a charge chrome quality product is produced.

In another embodiment of this invention, if the grade and/or the alloying metal to iron ratio of the alloying metal-containing feed material is too low, it is not possible to produce directly a charge chrome product, for example. In this embodiment further treatments are necessary. These further treatments may be carried out in one or more other vessels, or in the same vessel as used above for the initial smelting reduction of the alloying metal-containing material. If the same vessel is used, then the process must be a batch process. An example of such a process is:

(a) smelt the alloying metal-containing material as described in the preceding embodiment to produce a low alloying metal alloy and a discardable slag;
(b) increase the oxygen potential of the bath, which comprises the alloying metal alloy from the previous stage, so that it is mildly reducing so as to oxidise a substantial proportion of the alloying metal present in the metal phase, causing that alloying metal to transfer into the slag phase as oxides. The degree and duration of oxidation is limited, to restrict the amount of iron oxidised into the slag phase. By this process most of the iron stays in the metal phase, and most of the alloying metal is transferred to slag phase, such that the alloying metal to iron ratio of the slag phase is sufficient to yield, for example, a charge chrome ferroalloy after subsequent processing as follows;
(c) separate the alloying metal-depleted metal phase from the slag (the metal phase being a saleable product); and
(d) expose the alloy metal-containing slag to a reducing environment, such that most of the alloying metal and iron in the slag are reduced to metals, and thus give, for example, a charge ferrochrome alloy and a discard slag. Addition of fluxing agents may be necessary during this process to maintain desirable slag properties.

In yet another embodiment of this invention, if the grade and/or the alloying metal to iron ratio of the alloying metal-containing feed material is too low to produce directly a charge chrome product, for example, the following sequence of treatments may be conducted:

(a) operate the molten bath so that it is mildly reducing and reduces relatively more of the iron oxides than the alloying metal oxides in the alloying metal-containing material to the metallic states;
(b) separate the alloying metal-depleted metal phase from the alloying metal-containing slag (the metal phase being a saleable product);
(c) expose the alloying metal-containing slag to a reducing environment, such that most of the alloying metal and iron in the slag are reduced to metals, and thus give, for example, a charge ferrochrome alloy and a discard slag. Addition of fluxing agents may be necessary during this process to maintain desirable slag properties. This slag reduction operation can be conducted in the same vessel as was used for the initial smelting reduction of the alloying metal-containing materials, provided sufficient metal phase is left with the slag in the vessel.

The term 'mildly reducing' is relative. It implies that the oxidation potential of the bath has been increased relative to that of a 'reducing' bath.

A specific embodiment of the invention provides for the production of a crude stainless steel product, which may contain from 10 to 32% chromium.

The feed material charged to the furnace may be an alloying metal-material in fine or lump form, pellets, or composites of ore or concentrate combined with fluxing agents and or reductant. The feed material may be charged to the furnace either in a raw state, after drying, after preheating, or after preheating and partial prereduction. The feed material may be charged to the furnace in a hot state, carrying with it most of the heat energy gained from any preheating, or its temperature may be at or near ambient temperature.

It is preferred, for reasons of economy, that the carbonaceous material injected into the bath be anthracite or a bituminous coal; a particular advantage of this process being the ability to make use of such reducing agents. This carbonaceous material should normally be transported and injected through tuyeres pneumatically in an inert carrier gas such as nitrogen. An oxygen-containing gas, such as air, may be injected into the bath through tuyeres, and a reducing gas, such as natural gas, may be introduced through the same tuyeres around the oxygen-containing gas to provide protection for the tuyeres, thus preventing the formation of excessive temperatures in close proximity to the tuyeres. In consequence of the injection of these materials into the bath, there is a partial combustion of the carbonaceous material which supplies some of the heat requirements of the process and results in the generation of reaction gases. These reaction gases are the products of the partial combustion of the carbonaceous material and any protective gases together with any inert, or relatively inert, carrier gas. Suitable carrier gases are principally argon, nitrogen, carbon monoxide, carbon dioxide, hydrogen and water vapour.

The momentum of the gases injected into the bath and the evolution of the reaction gases from within the bath lead to efficient agitation of the bath. The escape of these gases from the molten bath into the space above the bath results in the projection of molten material from the bath into a transition zone above the level of the bath. Should the materials be injected from above the bath, it is still necessary to inject some gas into the bath to provide the necessary mixing within the bath and to project enough molten bath material into the transition zone for mixing of the slag and for heat transfer. It is preferred that the oxygen-containing gas injected into the space above the transition zone comprises air preheated to from 800° C. to 1200° C. It is particularly preferred that at least 60% of the oxygen requirements of the process be injected in a jet or jets of oxygen-containing gas into a space above the transition zone. The reaction gases then released from the bath into this space then combust with oxygen-containing gas. The gases so produced impinge on molten material in the transition zone. The heat generated by post-combustion is thereby transferred to molten material in the transition zone.

It is further preferred that a swirling action be imparted to the jet or jets of oxygen-containing gas in fluid communication with a space above the transition zone prior to the injection of the oxygen-containing gas into the space. The reaction gases released from the bath into the space combust with the jet or jets of swirling oxygen-containing gas injected into the space. The gases so produced impinge on molten materials in the transition zone whereby energy generated by the post-combustion is transferred to the molten material in the transition zone.

The term "swirling action" as used in this specification in relation to the jet of oxygen-containing gas is understood to mean that the oxygen-containing gas has a component of rotation about an axis parallel with the direction of movement of the jet.

It is still further preferred that the oxygen-containing gases be injected into the space above the transition zone via an annular orifice or orifices.

Whilst the orifices may be hollow cone shaped, they may also be in any suitable geometric form, for example:
annular slot tuyeres, such as circular or elliptical slot tuyeres; any other curved shapes; and
angular forms, such as triangles, rectangles, parallelograms or polygons.

It is preferred that the installation angle of the or each tuyere through which the oxygen-containing gas is injected into the space above the transition zone be from 10° to 90° to the quiescent bath surface, preferably from 30° to 90°.

It is also further preferred that reaction gases released from the bath combust with the jet or jets of oxygen-containing gas, which are injected into the space above the transition zone. The post-combusted gases so formed should impinge on molten material in the transition zone at a velocity in the range of from 30 to 200 m/s. By this means the heat generated by the post-combustion is transferred to the molten material in the transition zone.

It is to be understood that the invention in its general aspects is not limited to the specific details referred to above.

We claim:

1. A process for producing a ferroalloy or a slag that is capable of being converted to a ferroalloy comprising the following steps:

(a) injecting charge material including an alloying metal-containing material and a flux at controlled rates into a bath having a gas space thereabove; said bath containing molten material comprising a metal phase containing metallic iron;

(b) injecting a carbonaceous material at controlled rates into the bath or into a gas space above the bath or both;

(c) injecting an oxygen-containing gas at controlled rates into the gas space above the bath;

(d) injecting a gas into the bath to assist reaction gases formed in the bath to create a transition zone in the gas space above the bath by projecting molten material from the bath into the gas space above the bath;

(e) combusting in said gas space above the bath, by means of the oxygen-containing gas, combustible reaction gases emitted from the bath to provide heat of post combustion;

(f) utilizing the heat of post combustion to heat said molten material projected into the transition zone;

(g) allowing molten material projected into the transition zone to fall back into the bath thereby transferring to the bath the heat of post combustion;

(h) controlling the rate of injection of the alloying metal-containing material, the flux, the oxygen-containing gas and the carbonaceous material to achieve rapid incorporation of the alloying metal-containing material and the flux into the bath as well as to control the oxidation/reduction environment within the bath and the proportion of the heating by post combustion;

(i) causing the alloying metal-containing material to be reduced and an alloying-metal so produced to report to the metal phase to form a ferroalloy, or causing the alloy metal-containing material to be oxidized and report to a slag phase; and (j) recovering the ferroalloy from said metal phase or recovering said slag phase.

2. A process according to claim 1 wherein the charge material is injected into the gas space above the bath after the charge material has been pre-heated.

3. A process as claimed in claim 1, wherein the bath is maintained at a temperature in a range from 1300° to 1900° C.

4. A process as claimed in claim 3, wherein the temperature lies in a range from 1400° to 1800° C.

5. A process as claimed in claim 3, wherein the temperature lies in a range from 1500° to 1700° C.

6. A process as claimed in claim 1, wherein the combustible reaction gases are post-combusted to a minimum extent of from 40 to 60%.

7. A process as claimed in claim 1, wherein the carbonaceous material injected into the bath is anthracite or bituminous coal.

8. A process as claimed in claim 3, wherein the oxygen-containing gas comprises air preheated to a temperature in a range from 800° to 1300° C.

9. A process as claimed in claim 8, wherein the air is preheated to a temperature in a range from 1100° to 1300° C.

10. A process as claimed in claim 8, wherein the air is injected as an air jet and wherein the process includes the step of imparting a swirling motion to the air jet.

11. A process as claimed in claim 10, wherein the air jet is directed at an angle in the range of 10° to 90° with respect to the plane formed by a surface of the bath when quiescent.

12. A process as claimed in claim 11, wherein the angle lies in a range from 30° to 90°.

13. A process as claimed in claim 11, wherein the air jet impinges on molten material, in the transition zone at a velocity in a range from 30 to 200 m/s, whereby heat is transferred to the molten material by post combustion of the combustible reaction gases.

14. A process as claimed in claim 1, wherein the process includes the step of maintaining the molten material with a carbon content in a range from 3 to 12% by weight.

15. A process as claimed in claim 14, wherein the carbon content is maintained in a range from 4 to 9% by weight.

16. A process as claimed in claim 1, wherein the process is operated in a batch cycle, the alloying metal-containing material being charged to the bath for less than 100% of the batch cycle, reducing conditions being maintained within the bath for the remainder of the batch cycle so as to reduce the alloying metal-containing material.

17. A process as claimed in claim 1, wherein the alloying metal-containing material contains a relatively low proportion of alloying metal which is initially recovered in step (j) as a metal alloy having a low content of alloying metal and the process includes the additional steps of:

(k) forming a bath of the molten metal alloy;

(l) maintaining a mild oxidizing environment in the bath to oxidize the alloying metal and form an alloying metal depleted metal phase and an alloying metal enriched slag phase containing oxides of alloying metal and oxides of iron;

(m) removing the alloying metal depleted metal phase;

(n) subjecting the alloying metal enriched slag to a reducing environment to reduce oxides of alloying metal and iron contained in the slag to produce a ferroalloy; and (o) recovering the ferroalloy.

18. A process according to claim 1 wherein said bath further comprises slag.

19. A process according to claim 1 wherein said alloying metal comprises chromium.

20. A process according to claim 17 wherein said alloying metal comprises chromium.

21. A process according to claim 1 wherein step (i) comprises causing the alloying metal-containing material to be oxidized and report to a slag phase as oxides of alloying metal and causing iron to report to the slag phase as oxides of iron, wherein step (j) comprises recovering the slag phase; and wherein the process further comprises the steps of:

(k) removing the metal phase from the bath;

(l) subjecting the slag phase to a reducing environment to reduce oxides of alloying metal and oxides of iron contained in the slag to metal thereby producing a ferroalloy; and (m) recovering the ferroalloy.

* * * * *